United States Patent [19]

Burridge, Jr.

[11] 4,201,009

[45] May 6, 1980

[54] COMBINED HAT AND THROWABLE AMUSEMENT DEVICE

[75] Inventor: Len Burridge, Jr., Longwood, Fla.

[73] Assignee: Ronald G. Haag, Haines City, Fla.

[21] Appl. No.: 924,969

[22] Filed: Jul. 17, 1978

[51] Int. Cl.[2] ..... A63H 33/00

[52] U.S. Cl. ..... 46/1 F; 46/74 D; 2/175

[58] Field of Search ..... 46/74 D, 1 F; 273/106 B, 106 R, 106 F; 2/181.6, 184.5, 175, 171.3, 195, 196, 414; D2/230, 231

[56] References Cited

U.S. PATENT DOCUMENTS

| | | | |
|---|---|---|---|
| 1,036,004 | 8/1912 | Revell | 2/184.5 |
| 1,598,379 | 8/1926 | Kerr | 2/175 X |
| 1,991,829 | 2/1935 | Uriwal | D2/231 X |
| 2,418,069 | 3/1947 | Delano | D2/230 X |
| 2,835,073 | 5/1958 | Dame | 273/106 F X |
| 3,197,784 | 8/1965 | Carlisle | D2/231 X |
| 3,571,811 | 3/1971 | Wilson | 2/195 |
| 4,115,946 | 9/1978 | Vukmirovich | 46/74 D |

FOREIGN PATENT DOCUMENTS

| | | | |
|---|---|---|---|
| 105926 | 7/1924 | Switzerland | 2/181.6 |

*Primary Examiner*—Louis G. Mancene
*Assistant Examiner*—Mickey Yu
*Attorney, Agent, or Firm*—Stein & Frijouf

[57] ABSTRACT

A combined hat and throwable amusement device is disclosed wherein the hat when immersed in water obtains an aerodynamic stability whereby the hat may be sailed through the air as a saucer-like amusement device. The combined hat and throwable amusement device comprises a hat crown having an inverted bowl shape with a top region and a lower terminating edge. A substantially symmetrical hat brim extends from the terminating edge of the hat crown. The improvement comprises a plurality of slot apertures uniformly located about the hat crown with each of the slot apertures extending partially between the top region and the lower terminating edge of the hat crown. The plurality of slot apertures enable air currents to flow through the slot apertures to increase the aerodynamic stability of the device when the device is sailed through the air. The device includes a bouyant hat band to provide flotation to the device upon immersion in water. The foregoing abstract is merely a resume of one general application, is not a complete discussion of all principles of operation or application, and is not to be construed as a limitation on the scope of the claimed subject matter.

7 Claims, 6 Drawing Figures

COMBINED HAT AND THROWABLE AMUSEMENT DEVICE

BACKGROUND OF THE INVENTION

1. Field of the Invention

This invention relates to amusement devices and more particularly to a combined hat and throwable amusement device whereby the hat may be sailed through the air in a saucer-like mannner.

1. Description of the Prior Art

Over the past twenty years, the use of a saucer-like amusement device which is sailed through the air between two or more players, has reached a national craze. Approximately ten million of these saucer-like devices are presently being sold per year. It is generally accepted that this game began in the early 1950's when a pie manufacturer realized that a hard tin pie pan was suitable for sailing through the air. Since a tin pie pan could cause severe injury this led to the development of a semi-hard plastic disc with a flared underlip. This disc received national prominence and is presently being sold in great numbers throughout the country.

In general, these discs are thrown in open areas such as parks, campuses, open fields, beaches and the like. One of the major reasons which makes this device so popular is the relative ease of carrying compared to other games, such as baseball, football and the like.

It is a primary object of this instant invention to provide a combined hat and throwable amusement device which has a dual function in nature operating as a conventional hat and as a throwable amusement device. This combination will make the device completely portable and unobstrusive and readily available for spontaneous games.

Therefore, it is an object of this invention to provide a combined hat and throwable amusement device comprising a hat crown and a symmetrical hat brim extending from the terminating edge of the hat crown with a plurality of slot apertures uniformly located about the hat crown for enabling air current to flow through the plurality of slot apertures to increase the aerodynamic stability of the device when the device is sailed through the air.

Another object of this invention is to provide a combined hat and throwable amusement device wherein the hat crown and brim are water-absorbent for increasing the aerodynamic stability of the device upon immersion in water.

Another object of this invention is to provide a combined hat and throwable amusement device comprising a hat crown and a substantially symmetrical hat brim both being water-absorbent and with a bouyant hat band extending about the juncture of the hat crown to provide flotation to the device upon immersion in water.

Another object of this invention is to provide a combined hat and throwable amusement device constructed of a cloth material making the device very safe therby avoiding injury upon impact with unsuspecting persons.

Other objects and a fuller understanding of this invention may be had by referring to the summary of the invention, the description and the claims, taken in conjunction with the accompanying drawings.

SUMMARY OF THE INVENTION

The invention may be incorporated into a combined hat and throwable amusement device comprising a hat crown having an inverted bowl shape with a top region and a lower terminating edge. A substantially symmetrical hat brim extends from the terminating edge of the hat crown. The hat may be similar to a conventional cotton hat commonly referred to as a tennis hat or a surf hat. The improvement comprises a plurality of slot apertures uniformly located about the hat crown. Each of the slot apertures extend partially between the top region of the hat crown and the lower terminating edge. The plurality of slot apertures enable air currents to flow through the plurality of slot apertures to increase the aerodynamic stability of the device as the device is sailed through the air in a saucer-like manner.

In a more specific example of the invention, the hat crown and the hat brim are constructed of a water-absorbent material for increasing the aerodynamic stability of the device upon immersion in water. The crown and hat brim absorb moisture from the immersion in water thereby increasing the weight of the hat to increase the aerodynamic stability thereof. The hat brim preferably extends at a downward angle from the terminating edge of the hat crown.

A hat band may optionally extend about the hat at the juncture of the hat crown and the hat brim. The hat band may be made of a buoyant material for providing flotation to the device upon immersion into water. In a preferred embodiment, the hat band comprises an inner and an outer cloth material with a flotation material, such as styrofoam or the like disposed therein.

The major improvement of the device comprises the slot apertures located in the crown of the hat. The slot apertures may comprise slits in the hat crown extending approximately one-half the distance from the top region to the terminating edge of the crown. In a preferred embodiment of the invention, six slits are located about the hat crown. The hat crown may be constructed of a plurality of generally triangular shaped panels secured to one another by seams extending from the top region to the terminating edge of the hat crown. In such an example, the plurality of slot apertures comprise slits in each of the seams between adjacent triangular panels. Alternatively, the slot apertures may be disposed within each of the triangular shaped panels.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION

Figure 1:
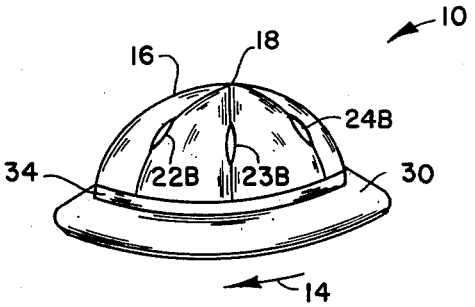
FIG. 1 is an elevational view of the combined hat and throwable device being sailed through the air.
Figure 2:
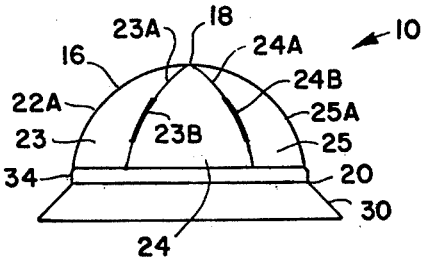
FIG. 2 is a side elevational view of the combined hat and throwable amusement device shown in Fig. 1.
Figure 3:
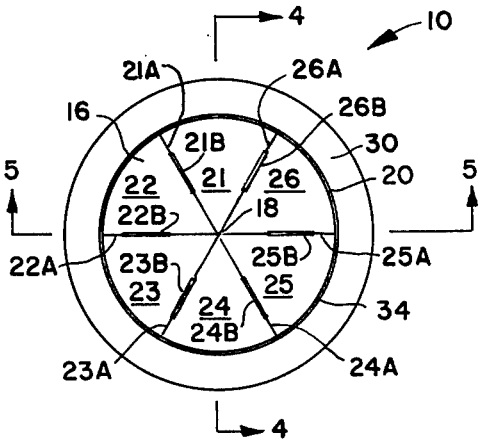
FIG. 3 is a plan view of the device shown in FIG. 2.
Figure 4:
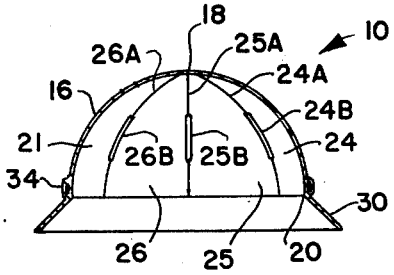
FIG. 4 is a sectional view along line 4—4 of the amusement device in FIG. 1.
Figure 5:
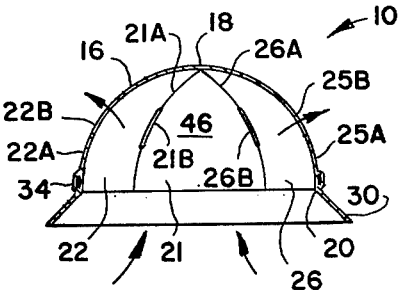
FIG. 5 is a sectional view along line 5—5 of the amusement device shown in FIG. 3.

FIG. 1 illustrates a combined hat and throwable amusement device 10 being sailed through the air in a saucer-like manner. The device 10 is thrown such that the device 10 rotates in either a clockwise or a counter-clockwise direction, depending upon the hand used to throw the device. In this example, the improved hat and throwable amusement device 10 is rotating in a clockwise direction as indicated by the arrow 14. Although the device 10 is not illustrated resting upon the head of a player the dual utility of the hat and the throwable amusement device should be understood.

FIGS. 2-5 illustrate various views of the device 10 such that the improvement may be readily understood. The device comprises a hat crown 16 having a top region 18 and a terminating edge 20. The crown 16 has the substantial shape of an inverted bowl with the crown 16 being composed of six substantially triangular panels 21-26.The triangular panels 21-26 are sewn along seams 21A-26A to create the hat crown 16.

The combined hat and throwable hat 10 includes a substantially symmetrical hat brim 30 which extends at a downward angle from the terminating edge 20 of the hat crown 16. The crown 16 and brim 30 are preferably made of a water-absorbent material such that the hat increases in weight upon immmersion in water thereby increasing the aerodynamic stability of the device 10.

Figure 6:
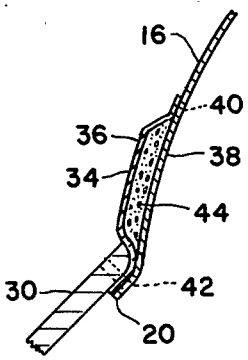
FIG. 6 is an enlarged partial sectional view of the hat band of the combined hat and throwable amusement device shown in FIGS. 1-5.

A hat band 34 extends about the crown 16 of the hat 10 at the junction of the crown 16 and the brim 30. FIG. 6 shows an enlarged sectional view of the hat band 34 comprising an outer cloth member 36 and an inner cloth member 38 sewn at seams 40 and 42. A flotation material 44 such as styrofoam or the like is interposed between the outer and inner cloth members 36 and 38 to provide flotation when the device 10 is immersed in water. The crown 16 and the brim 30 and the hat band 34 may be assembled by conventional sewing or the like.

The improvement of the combined hat and throwable device 10 resides in part in the plurality of slot apertures shown as 21B-26B which extend at least partially between the top region 18 and the terminating edge 20 of the crown 16. The plurality of slot apertures 21B-26B enable air currents to flow through the plurality of slot apertures 21B-26B to increase the aerodynamic stability when the device 10 is sailed through the air. The slots as shown in FIGS. 2-5 comprise slits which extend approximately one-half of the distance from the top region 18 to the terminating edge 20. In this embodiment, the slits 21B-26B are included within each of the seams 21A-26A between the adjacent triangular-shaped panels 21-26. However, it should be appreciated that the slots 21B-26B may be located within the panels 21-26.

The device 10 has been found to be extremely safe enabling the device to be caught on the head, toes, fingers and the like. The device 10 obtains aerodynamic stability a few feet after release by the player. It is believed that the air currents enter the inside of the hat 46 and exit through the slits 21B-26B as shown by the arrows in FIG. 5, to provide the additional stability over a conventional hat. The slot apertures 21B-26B open slightly due to the centrifugal force of the rotation of the device 10 as the device 10 sails through the air. FIG. 1 illustrates the slight opening of slot apertures 21B-26B enabling the air to exit after entrance through the open bottom of the device 10. Other experiments have been performed with widening the slots and extending the slots between the top region 18 and the terminating edge 20. It has been found that the slots are preferably long and narrow and extending approximately half the distance between the top region 18 and the terminating edge 20. In a specific device 10 constructed in accordance with the instant invention, the hat 10 included a two inch hat brim 30 and a one inch wide hat band 34. The hat crown 16 includes six equal triangular panels 21-26 each being six inches from the top region 18 to the terminating edge 20. The distance of each triangular panel 21-26 along the terminating edge 20 was three and three quarter inches. Each of the slot aperture 21B-26B was a buttonhole slit being two and one-half inches in length and located one inch above the hat band 34 or two inches above the terminating edge 20. The hat brim 34 extended from the hat crown 16 at an approximate angle of thirty to forty five degrees.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

Now that the invention has been described:

What is claimed is:

1. A combined hat and throwable amusement device, comprising in combination:

a hat crown having an inverted bowl shape with a top region and a lower terminating edge;

a substantially symmetrical hat brim extending from said terminating edge of said hat crown;

said hat crown and said hat brim being a flexible and a water-absorbent material for increasing the weight of the hat upon immersion in water;

the increased weight of the hat as a result of the absorbed water increasing the aerodynamic stability of the device;

a plurality of slot apertures uniformly located about said hat crown with each of said slot apertures extending only partially between said top region and said lower terminating edge enabling air current to flow through said plurality of slot apertures to increase the aerodynamic stability of the device when the device is sailed through the air;

said plurality of slot apertures slightly opening as a result of the centrifugal force of the rotation of the device as the device sails through the air; and a hat band extending about said hat crown comprising a buoyant material to provide flotation to the device upon immersion of the device in water 2. A device as set forth in claim 1, wherein said hat brim extends at a downward angle from said terminating edge of said hat crown.

3. A device as set forth in claim 1, wherein said hat band comprises an inner and outer cloth material with a flotation material disposed therebetween.

4. A device as set forth in claim 1, wherein each of said slot apertures extends approximately one-half the distance from said top region to said terminating edge.

5. A device as set forth in claim 1 wherein said plurality of slits comprise at least six slot apertures located about said hat crown.

6. A device as set forth in claim 1, wherein said hat crown includes a plurality of generally triangularly shaped panels secured to one another by seams extending from said top region to said terminating edge; and said plurality of slot apertures including a slot in each of said seams between adjacent triangularly shaped panels.

7. A device as set forth in claim 6, wherein each of said slots is an elongated buttonhole extending approximately one-half the distance from said top region to said terminating edge.

* * * * *